United States Patent [19]

Greeson

[11] Patent Number: 4,648,518

[45] Date of Patent: Mar. 10, 1987

[54] SELF-LIFTING GANTRY CRANE AND BOOM THEREFOR

[76] Inventor: Logan C. Greeson, 1286 Marine Dr., West Palm Beach, Fla. 33409

[21] Appl. No.: 735,165

[22] Filed: May 17, 1985

Related U.S. Application Data

[63] Continuation-in-part of Ser. No. 558,456, Dec. 6, 1983, abandoned.

[51] Int. Cl.[4] ..... B66C 23/32

[52] U.S. Cl. ..... 212/199; 212/211; 212/219

[58] Field of Search ..... 212/175, 182, 199, 202, 212/203, 204, 208, 209, 211, 218, 219, 228, 223–225, 257

[56] References Cited

U.S. PATENT DOCUMENTS

| | | | |
|---|---|---|---|
| 242,271 | 5/1881 | Capen | 212/223 |
| 874,778 | 12/1907 | Lubcke | 212/208 |
| 1,486,120 | 3/1924 | Bayles | 212/225 |
| 3,059,782 | 10/1962 | Baudhuin | 212/218 |
| 3,556,252 | 1/1971 | Atkins | 212/199 |
| 3,656,631 | 4/1972 | Rauch et al. | 212/182 |

FOREIGN PATENT DOCUMENTS

| | | | |
|---|---|---|---|
| 2201451 | 7/1973 | Fed. Rep. of Germany | 212/228 |
| 2629253 | 1/1978 | Fed. Rep. of Germany AA | 294/67 |
| 3024618 | 1/1982 | Fed. Rep. of Germany | 212/204 |
| 113393 | 3/1945 | Sweden | 212/203 |
| 12277 | of 1908 | United Kingdom | 212/196 |
| 650959 | 3/1979 | U.S.S.R. | 212/204 |
| 1000378 | 2/1983 | U.S.S.R. | 212/223 |

OTHER PUBLICATIONS

Whiting, Jib Cranes, Engineering News Record, May 3, 1917, p. 193.

*Primary Examiner*—Sherman D. Basinger
*Assistant Examiner*—Stephen P. Avila
*Attorney, Agent, or Firm*—Victor F. Volk

[57] ABSTRACT

A gantry with an overhead trolley boom has a cable-sheave arrangement enabling it to use its winch to lift itself into a building.

8 Claims, 8 Drawing Figures

SELF-LIFTING GANTRY CRANE AND BOOM THEREFOR

This application is a continuation-in-part of copending application Ser. No. 558,456; filed Dec. 6, 1983, now abandoned, which was related to and used features of a copending application Ser. No. 524,746, filed Aug. 8, 1983, now abandoned.

BACKGROUND OF THE INVENTION

This invention relates to multistorey building construction and particularly to means for lifting loads to the upper stores at low cost and with a minimum of manpower.

In multistorey building construction, in order to raise laods of dry wall and other construction materials and stock them on the individual floors, it has been required to bring a heavy crane to the building site and/or construct a temporary elevator at the exterior of the building under construction. These have been very labor intensive operations, requiring as many as eight men to raise a load from ground level to its required position in the building. The presently described operation makes it possible for a single laborer to install a crane on the required floor and thereafter deliver loads of materials at that and lower floors without the necessity for an elevator or for an outside crane.

SUMMARY OF THE INVENTION

I have invented a new and useful rolling gantry crane comprising a frame with a horizontal overhead beam that comprises two cantilevered lengths extending from opposite ends. My gantry crane frame also has winch means and wire rope cable mounted on it, a first sheave means mounted on the beam for guiding the cable to a load on the ground below, and second sheave means that is mounted on the frame in a position to guide the cable upwardly so that the gantry crane can lift itself into a building when the cable has been connected to an overhead support. The gantry crane also comprises a third sheave means for alternatively guiding the same cable to the first sheave means on the beam. Preferably, my rolling gantry crane comprises jacking means fixed to the frame and extensible downwardly from it, and columnar members that are lockingly adjustable upwardly from the frame so that, by extending both the jacking means and the columnar members the frame will be wedged and locked between two floors of a building.

Preferably, also, the aforesaid beam includes a trolley that rides it and the first sheave means are mounted on this trolley, which advantageously will include chain means to move it and a motor such as hydraulic motor to drive the chain means. The gantry frame is preferably mounted on four wheels at least one of which should be driven by another hydraulic motor. These motors and a winch that is mounted on the frame, and also the jacking means which are preferably hydraulic, are all driven by fluid from a pump that is mounted on the frame along with an internal combustion engine that drives the pump.

As a support for lifting my gantry crane to the desired floor I have invented a vertically fixed horizontal swingable boom apparatus that comprises an upper elongated support member such as a length of square cornered steel tubing and a lower, substantially elongated support member such as a similar length of tubing. The lower length has threaded bores near each end through which threaded rods are fitted that have upper plate-like contact heads and lower turning handles. End means rigidly connect the upper and lower elongated support members and include a shaft for a vertical bearing on which is mounted the horizontal swingable boom. To stabilize my boom support the upper support member may advantageously comprise a right angled cross member.

BRIEF DESCRIPTION OF THE DRAWING

FIGS. 1*a*, 1*b*, 1*c* show a perspective view of my rolling gantry crane.

DETAILED DESCRIPTION OF A PREFERRED EMBODIMENT

Figure 1A:
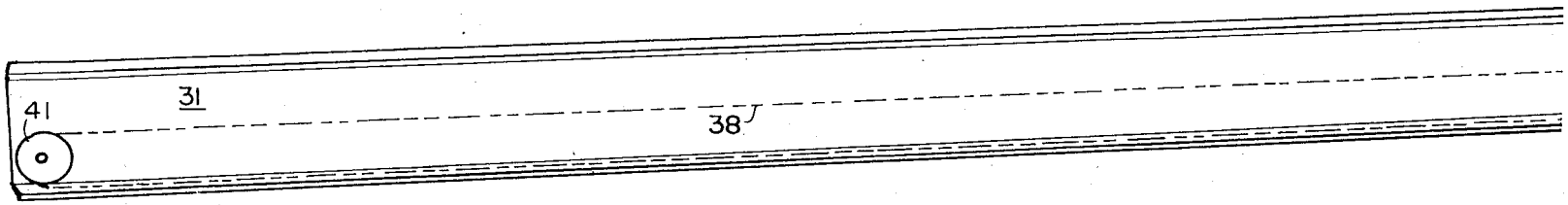
Figure 3:
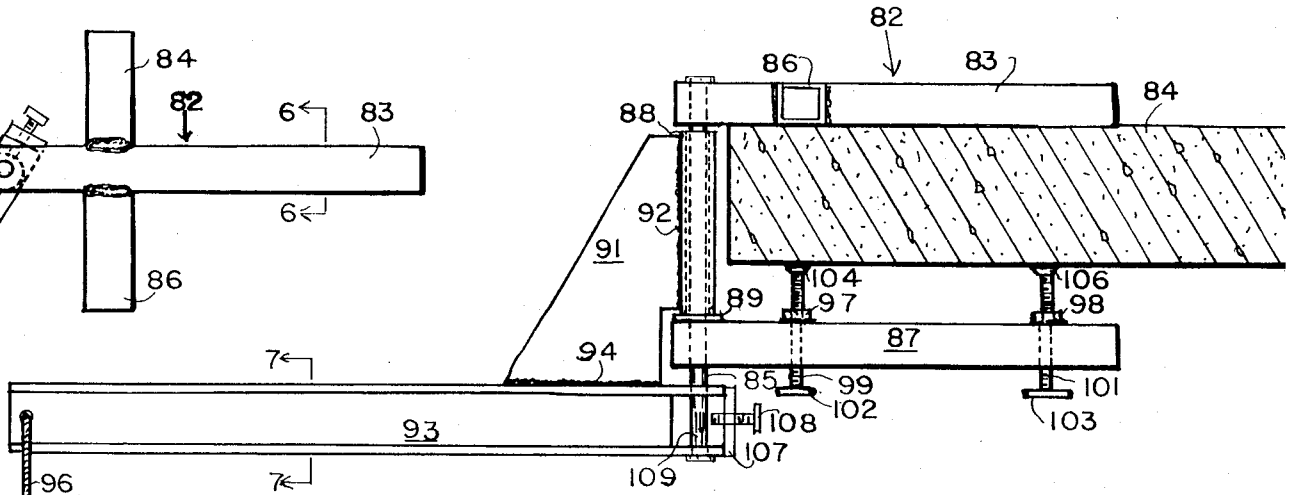
FIG. 3 shows a side view of the swingable boom of my invention.
Figure 4:
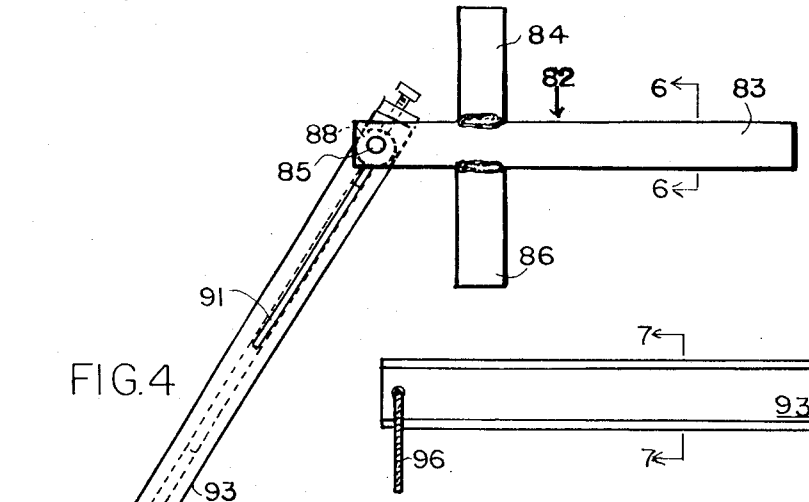
FIG. 4 shows a plan view of the swingable boom of my invention.
Figure 7:
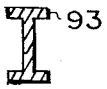
FIG. 7 shows a section through the lines 7—7 of FIG. 3.
Figure 6:
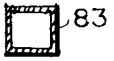
FIG. 6 shows a section through the lines 6—6 of FIG. 4.

Referring first to FIG. 1*b*, a rolling gantry crane 11 has a frame 12 constructed basically of structural steel square sections forming four columns 13,14, 15, 16. Upper cross member 17 is welded to the columns 13, 16 and upper cross member 21 is similarly welded to the columns 14, 15. The member 17 is reinforced by gussets 22, 23 and the member 21 by similar gussets 19 and another not shown. Upper lengthwise members 24, 26 are welded to the members 17, 21 and to the respective columns 13, 16 and 14, 15. Lower lengthwise members 27, 28 are welded respectively to the columns 15, 16 and 13, 14. The frame 12 thus formed is deliberately modest in size, the cross members 17, 21 being typically 6 feet (2 m.) long, and the lengthwise members 24, 26, 27, 28 about 8 feet (2.4 m). An I-beam 29 has its top portion welded to the cross members 17,21. The beam 29 is much longer than the rest of the frame 12 snd has cantilevered portions 31 and 32 extending beyond the frame to serve as booms that project from one side or the other of a building in which the crane has been installed. The I-beam 29 supports a conventional trolley 33 with a sheave 34 for a wire rope cable 36 that pays from a winch 37. The trolley 33 is moved back and forth on the beam 33 by a chain loop 38 riding over sprockets 39, 41 which are mounted at either end of the beam 33. The sprocket 41 is driven by an hydraulic motor 42 also mounted on the beam 33. The motor 42 is fed by a conventional high-pressure line, not shown, from a pumping unit 43 that is mounted on the structural member 28 along with internal combustion gas engine 44 which drives the pump 43.

Figure 1C:
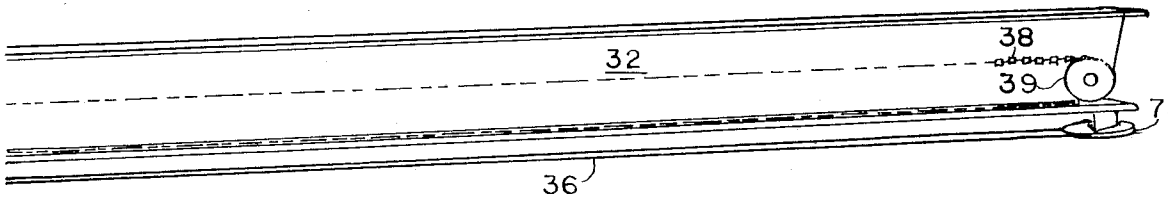

Four industrial hard-tire wheels 46, 47, 48 (the fourth wheel opposite wheel 48 is not shown) support the gantry frame 11 and permit it to roll across the floor of a building under construction so that the prtions 31 or 32 can project from one side or the other of the building. The wheel 48 is simply driven by another hydraulic motor 49 by means of sprockets 45 and 50 and chain 40. The wheels 46, 47, 48 and the one not shown are mounted to the lower lengthwise members 27, 28 by means of plates such as the plates 51-51 (FIG. 1*b*) welded thereto at positions set in a short distance from the ends of the members 27, 28 so as to allow room for four hydraulic jacks 52, 53, 54 and one not shown connected to the members 27, 28 at the corners of the frame 12. The jacks are mounted so that their piston shafts extend downwardly enough to lift the frame off the four wheels when hydraulic fluid is pumped into them from the pump 13 through piping, not shown, but under control of a hydraulic control box 56 that is mounted on the member 27 along with an operator's seat 57. The four jacks cooperate with four columnar members 58, 59, 60, 61 that fit through openings in the members 24, 26 and into the columns 13, 14, 15, and 16 to lock the gantry in position. These columns have openings 62-62 cooperating with a series of holes 63 through the columnar members 58-61 to receive locking pins 64-64. The members 58-61 are topped with tough rubber bumpers 66-66 that press against the ceiling when the jacks are extended, and wedge in the crane 11. In normal operation when the crane has been installed the cable 36 passes from the winch 37 through a hollow platform 67 to a sheave 68 mounted on the column 12 by a bracket 69 and thence upward to a sheave 71 also bracketed to the column 12. The sheave 71 directs the wire-rope cable to a horizontal sheave 72 that is mounted on the I-beam 29 whence the cable passes to another horizontal sheave 73 mounted on the right cantilevered end 31 (FIG. 1*c*) of the beam 29. Thence the cable 36 passes back over the sheave 34 where it supports a hook 74 and any load attached thereto.

Figure 2:
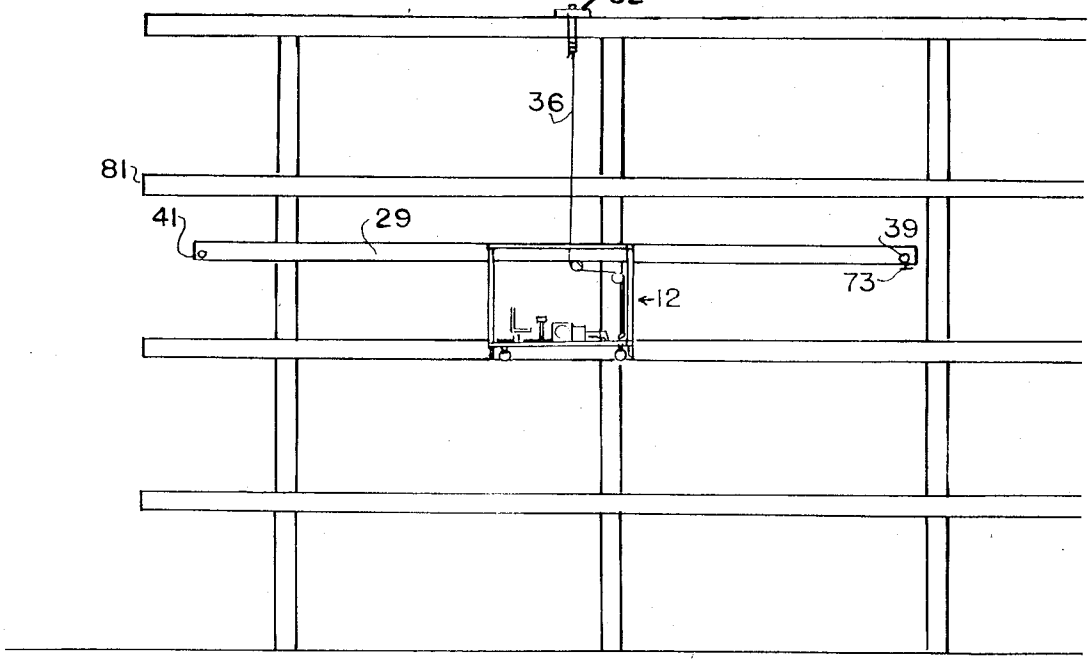
FIG. 2 shows a side view of my crane lifting itself at a building site.
Figure 5:
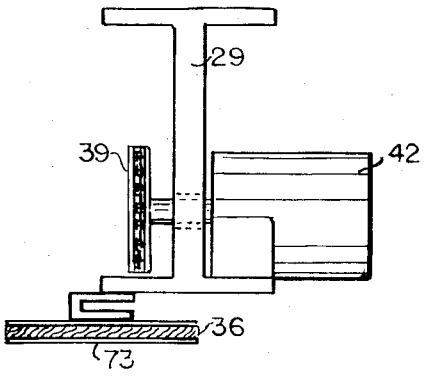
FIG. 5 shows an end view of the I-beam of my gantry crane.

However an important novel feature of my invention resides in the self-climbing capacity of my gantry. When the gantry is still on the ground it is capable of lifting itself by having the cable 36 upon leaving the pulley 68 pass over sheave 76 bracketed to the column 12. The sheave 76 is aligned with a sheave 77 that is supported on a cross beam 78 by means of a bracket 79. The cross beam 78 is welded on one end to the I-beam 33 and on the other to the lengthwise beam 26 and is so placed that the sheave 77 will guide the cable 36 upwardly above the center of gravity of the gantry, as illustrated in FIG. 2 where the gantry 12 is being raised to be deposited on the top floor of a building 81 under construction. The hook 74 is detachable from the cable 36 so that the cable can be removed from the trolley 33 and the hook later replaced in a known manner.

When the crane is being self-hoisted up the side of a building the cable is attached to swingable boom assembly 82 of my invention which is characterized by light weight and portability so that it can be carried up to the roof of a building by one man and installed by him. The beam assembly comprises a 4×4 inch (10×10 cm.) hollow square of ¼ inch (6.4 mm) thick steel about 3 feet (1 m) long to which have been welded two short lengths 84, 86 of the same material so that the cross thus composed will lie flat on a concrete building slab edge such as the slab 84. The member 83 is rigidly welded to a vertical pipe length, or solid shaft, 85 long enough to span the slab thickness, and another square member 87 is similarly welded to the pipe 85, but between the two welds a tubular bearing 88 and grease plate 89 have been fitted over the pipe 86. A gusset plate 91 welded by the welding 92 to the bearing 88 is also welded to an I-beam 93 by welding 94 to rigidly suport the I-beam which then serves as a swingable boom when it is rotated, taking the load on the grease plate 89. A loop of wire rope or solid metal ring through the I-beam serves as a means of attachment of the hook 74 or other such hook.

The member 87 is perforated at spaced apart points where threaded nuts 97, 98 have been welded to receive threaded rods 99, 101 with handles 102, 103 which enable them to be turned against the under surface of the slab 84 to secure the swingable boom in place. Flat heads 104, 106 cap the ends of the rods 99, 101. To lock the angular position of the I-beam 93 plate 107 with a threaded aperture for receipt of a threaded bolt 108 is welded across the flanges of the I-beam 93. The pipe 86 is ridged in a central area 109 between the flanges to present a locking seat for the rod 108.

In the practice of using my invention the swingable boom 82 is fixed to an upper slab, usually the roof slab of a building under construction, the cable 36 on the gantry 11 is directed upwardly over the sheave 79 and the hook 74 fitted into the loop 96 of the boom. This may be done by dropping a light line from the location of the boom and having the winch 37 pay out cable while the line is pulled up, the winch 37 having a fail-safe feature of being locked whenever its motion is not activated. When the hook has been secured the winch is reversed to draw in cable thereby raising the gantry by its own power to the desired floor, usually the top floor where, because of its gantry construction it can bring palleted loads and carry them by means of the trolley 33 directly into the floor on which it is, itself, located. Of course, loads can be taken off on lower floors by swinging them in, treating the I-beam 29 as an overhead crane. The I-beam 29 and trolley 33 can, of course, lift much greater loads than the boom 82 which is characterized by its light weight to be portable le by a lone workman since it is only required to lift loads under about two tons (4400 kg). This is possible because of the modest dimensions and low weight of the gantry itself which depends on its ability to lock itself between floors, rather than dead weight for counterbalancing its crane. Because all its motors are hydraulic and powered ultimately by the internal combustion engine 44 my gantry crane can be used in locations where electricity has not yet been installed, without the complication of bringing in an electric power supply.

The foregoing description has been exemplary rather than definitive of my invention for which I desire an award of Letters Patent as defined in the appended claims.

I claim:

1. A rolling gantry crane in combination with lifting boom means therefor for use in a multi-storey building comprising:

(A) a frame, (B) a horizontal overhead beam centrally fixed to said frame, said beam comprising a cantilevered length thereof extending from an end of said frame, (C) which means and cable stored thereon mounted on said frame, said winch means being capable of drawing in or paying out said cable, (D) an overhead support comprising a horizontally swingable boom fixed to said building.

(E) first sheave means mounted on said beam for guiding said cable to a load, second sheave means mounted on said frame in a position to guide said cable upwardly whereby said gantry crane can lift itself from floor to floor up the side of a building, said cable being connected to said overhead support, and means for alternatively guiding said cable to said first sheave means, whereby said winch means can lift a load, said load being connected to said cable.

2. The rolling gantry crane of claim 1 comprising jacking means fixedly mounted on said frame and extensible downwardly therefrom.

3. The rolling gantry crane of claim 2 comprising a plurality of columnar members lockingly adjustable upwardly from said frame whereby said frame can be locked between two floors of a building by extending both said columnar members and said jacking means.

4. The rolling gantry crane of claim 3 comprising a trolley riding said beam, said first sheave means being mounted on said beam by means of said trolley.

5. The rolling gantry crane of claim 4 comprising chain means moving said trolley on said beam, and a motor driving said chain means, said motor being mounted on said beam.

6. The rolling gantry crane of claim 5 comprising wheels for supporting said frame and at least one motor driving at least one of said wheels.

7. The rolling gantry crane of claim 6 comprising a fluid pump, and wherein said motors driving said winch and said jacking means are hydraulic and are operated by fluid from said pump.

8. The rolling gantry crane of claim 1 comprising two cantilevered lengths of said beam extending from opposite ends of said frame.

* * * * *